US006329896B1

(12) United States Patent
Lu et al.

(10) Patent No.: US 6,329,896 B1
(45) Date of Patent: Dec. 11, 2001

(54) LOW-VOLTAGE BOBBIN FOR PREVENTING SOCKETS FROM DISPLACING

(75) Inventors: Shao An Lu; Gie Chain Hoang, both of Taoyuan (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 09/490,695

(22) Filed: Jan. 24, 2000

(30) Foreign Application Priority Data

Oct. 14, 1999 (TW) ..... 0881177

(51) Int. Cl.[7] ..... H01F 27/02; H01F 27/29

(52) U.S. Cl. ..... 336/90; 336/192; 336/65; 336/198

(58) Field of Search ..... 336/198, 268, 336/192, 96, 65, 90

(56) References Cited

U.S. PATENT DOCUMENTS 4,475,097 * 10/1984 Kikuchi ..... 336/192
4,499,522 * 2/1985 Nakamura ..... 361/836
6,010,362 * 1/2000 Caviness et al. ..... 439/567

FOREIGN PATENT DOCUMENTS 7-75339 * 3/1995 (JP) .
7-249532 * 9/1995 (JP) .

* cited by examiner

*Primary Examiner*—Anh Mai
(74) *Attorney, Agent, or Firm*—Oppenheimer Wolff & Donnelly, LLP

(57) ABSTRACT

The present invention provides a low-voltage bobbin of a flyback transformer. The flyback transformer comprises the low-voltage bobbin, a lower core and an upper core. The low-voltage bobbin comprises a main body and a reinforced device. The main body comprises a skirt and a winding shaft. The skirt has a lower opening for receiving the lower core. A plurality of sockets are provided on a side portion of the skirt. The winding shaft is provided on the skirt and has an upper opening for receiving the upper core. The reinforced device is provided on the skirt for reinforcing rigidity of the main body and preventing the plurality of sockets from displacing. In addition, the reinforced device comprises three ribs integrally formed on a flange of the skirt. Each rib is vertically connected with each other to form a hole. The lower core engages with the low-voltage bobbin through the hole according to a predetermined assembly procedure.

5 Claims, 6 Drawing Sheets

LOW-VOLTAGE BOBBIN FOR PREVENTING SOCKETS FROM DISPLACING

FIELD OF THE INVENTION

The present invention relates to a low-voltage bobbin, and more particularly, to a low-voltage bobbin of a flyback transformer.

BACKGROUND OF THE INVENTION

A flyback transformer is generally implemented within the circuits of a display device for providing distinctive voltages required by the circuits operation of the display device. Some U.S. Patents, i.e. U.S. Pat. Nos. 5,160,872, 5,287,479 and 4,144,480 may be referred in order to have an in-depth understanding of structures of the flyback transformer and functions of the High Voltage output, Focus output and Screen output of the flyback transformer.

Please refer to FIGS. 1 and 2. FIG. 1 is a schematic diagram of a flyback transformer 10 according to the prior art. FIG. 2 is an exploded diagram of the flyback transformer 10 shown in FIG. 1. Flyback transformer 10 of the prior art comprises a low-voltage bobbin 12, a high-voltage bobbin 14, an upper core 16, a lower core 18 and a housing 20. The assembly procedure of the flyback transformer 10 comprises: first, installing a winding shaft (not shown) of the low-voltage bobbin 12 into a shaft hole (not shown) of the high-voltage bobbin 14; secondly, installing the low-voltage bobbin 12 and high-voltage bobbin 14 into the housing 20; finally, mounting the upper and lower cores 16, 18 on the low-voltage bobbin 12 to form the flyback transformer 10.

In general, a clip 22 is often used to mount the upper and lower cores 16, 18 on the low-voltage bobbin 12 within the assembly procedure of the flyback transformer 10. The clip 22 is made of nonmagnetic metallic material with good flexibility to achieve the purpose of mounting the upper and lower cores 16, 18. However, the use of clip 22 increases the cost, and more particularly, a side opening 25 must be provided on the low-voltage bobbin 12 for receiving the lower core 18. Finally, it always leads to decrease the structural rigidity of the low-voltage bobbin 12. As a result, a shrinkage problem arises within the injection process of the low-voltage bobbin 12. A plurality of sockets 24 provided on the low-voltage bobbin 12 would displace and fail to comply with the original design requirement.

Based on the above issues, a re-positioning process of the sockets is usually required during the injection process between the low-voltage bobbin 12 and the high-voltage bobbin 14 in order to enforce a pin 26 corresponding to each socket 24 back to its original position as possible. Nevertheless, the result of the re-positioning process also fails to comply with the original design requirement because of stress recovery.

Please refer to FIG. 3. FIG. 3 is a schematic diagram of a reinforced rib 28 of the low-voltage bobbin 12 according to the prior art. With respect to the above-mentioned problem of socket displacement in the low-voltage bobbin 12, a rectangular reinforced rib 28 is provided on a skirt 29 to increase the structural rigidity of the low-voltage bobbin 12. However, the existence of the reinforced rib 28 will affect the assembly procedure of the upper and lower cores 16, 18. Therefore, the reinforced rib 28 should be punched off to create said side opening 25 for receiving the lower core 18 before the assembly procedure of the upper and lower cores 16, 18.

SUMMARY OF THE INVENTION

This invention provides a low-voltage bobbin of a flyback transformer. The flyback transformer comprises a low-voltage bobbin, a lower core and an upper core. The low-voltage bobbin comprises a main body and a reinforced device. The main body comprises a skirt and a winding shaft. The skirt has a lower opening for receiving the lower core. A plurality of sockets are provided on a side portion of the skirt. The winding shaft is provided on the skirt and has an upper opening for receiving the upper core. The reinforced device is provided on the skirt for reinforcing rigidity of the main body and preventing the plurality of sockets from displacing. In addition, the reinforced device comprises three ribs integrally formed on a flange of the skirt. Each rib is vertically connected with each other to form a hole. The lower core engages with the low-voltage bobbin through the hole according to a predetermined assembly procedure. Therefore, the flyback transformer applied with the low-voltage bobbin of the present invention will no longer apply a clip for mounting the upper and lower cores. The product cost will be reduced and the socket displacement of the low-voltage bobbin will be solved by applying the present invention.

DETAILED DESCRIPTION OF THE PREFERRED EMBODIMENT

Figure 1:
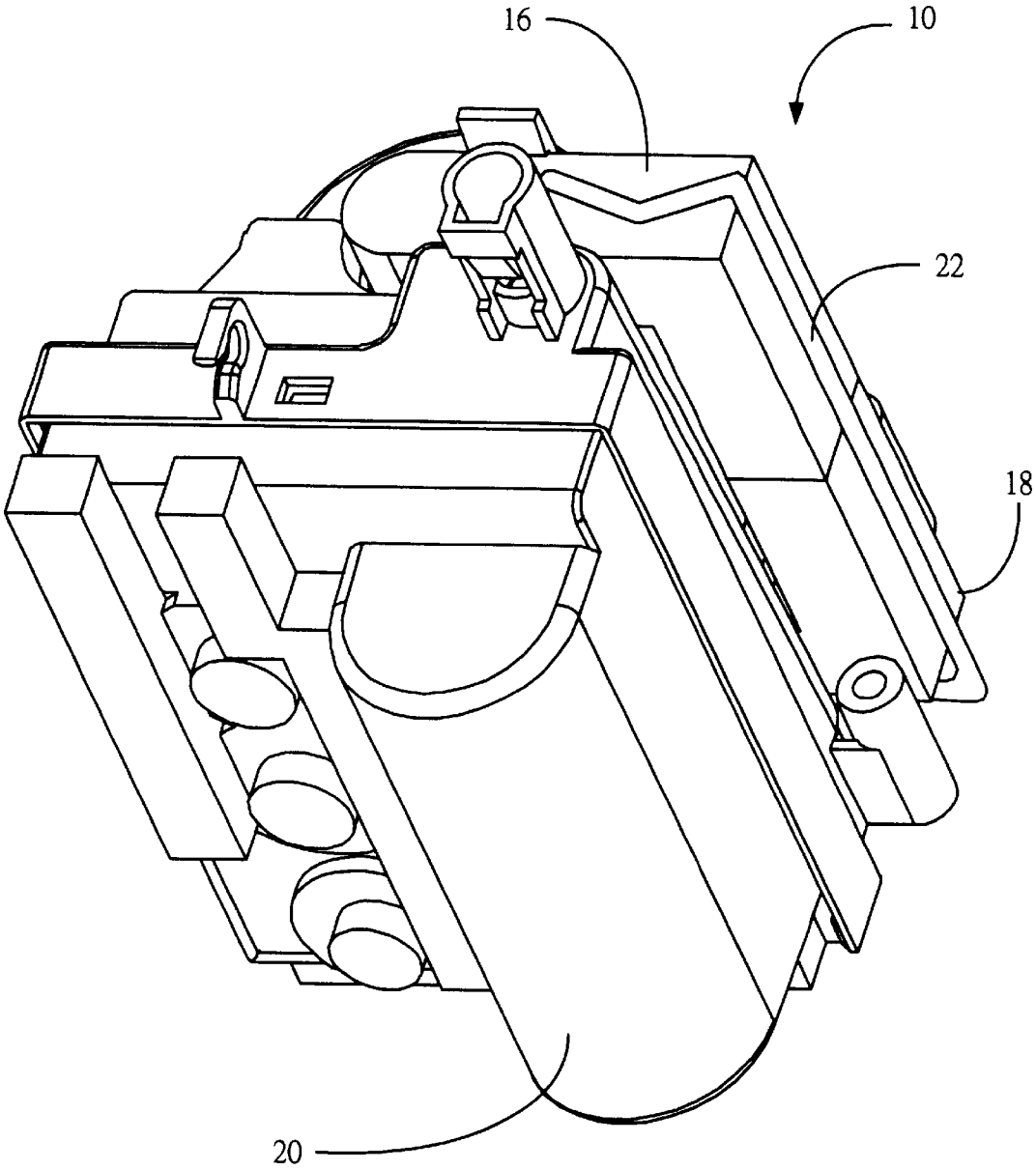
FIG. 1 (PRIOR ART)
FIG. 1 is a schematic diagram of a flyback transformer according to the prior art.
Figure 2:
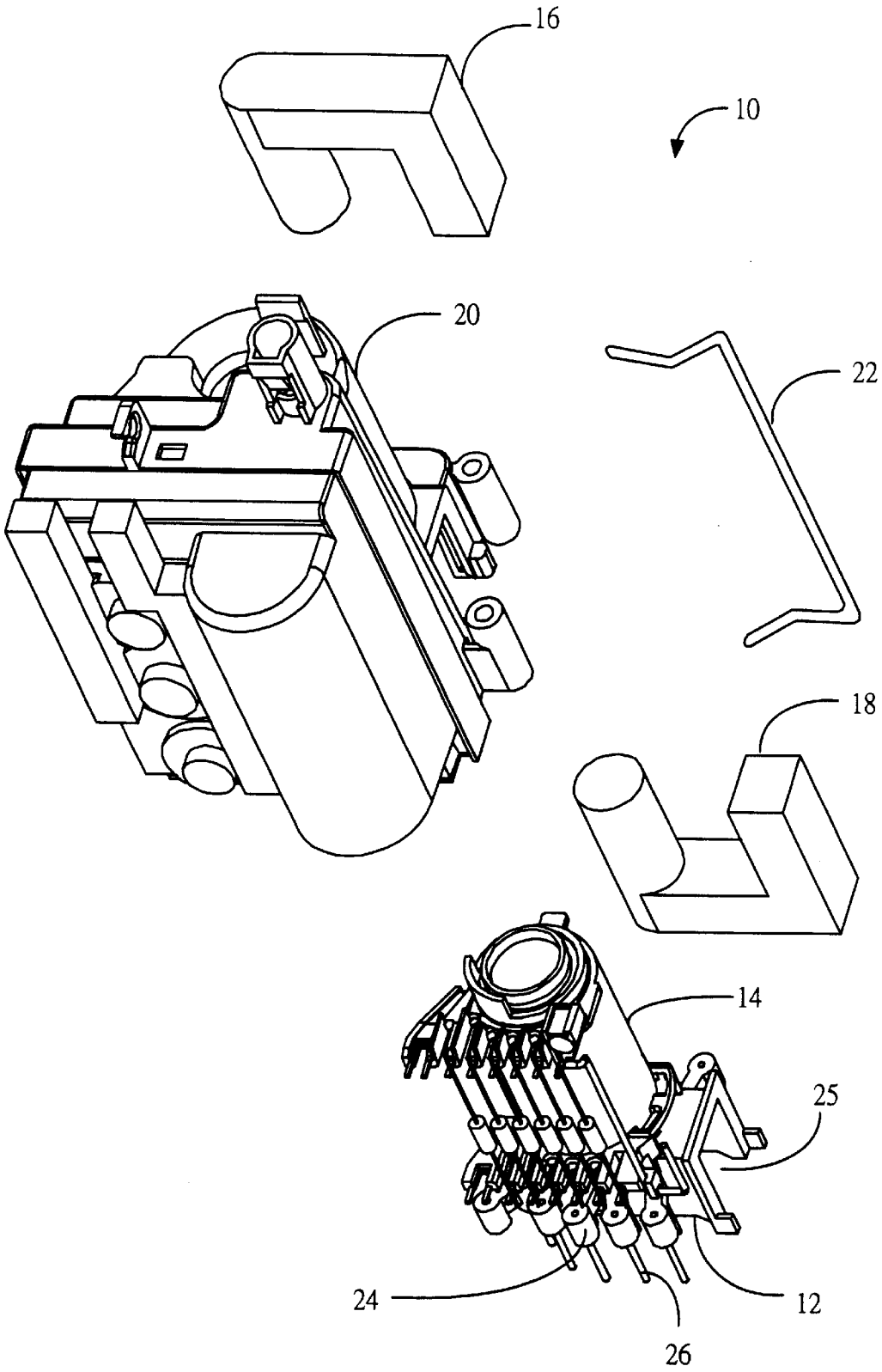
FIG. 2 (PRIOR ART)
FIG. 2 is an exploded diagram of the flyback transformer shown in FIG. 1.
Figure 3:
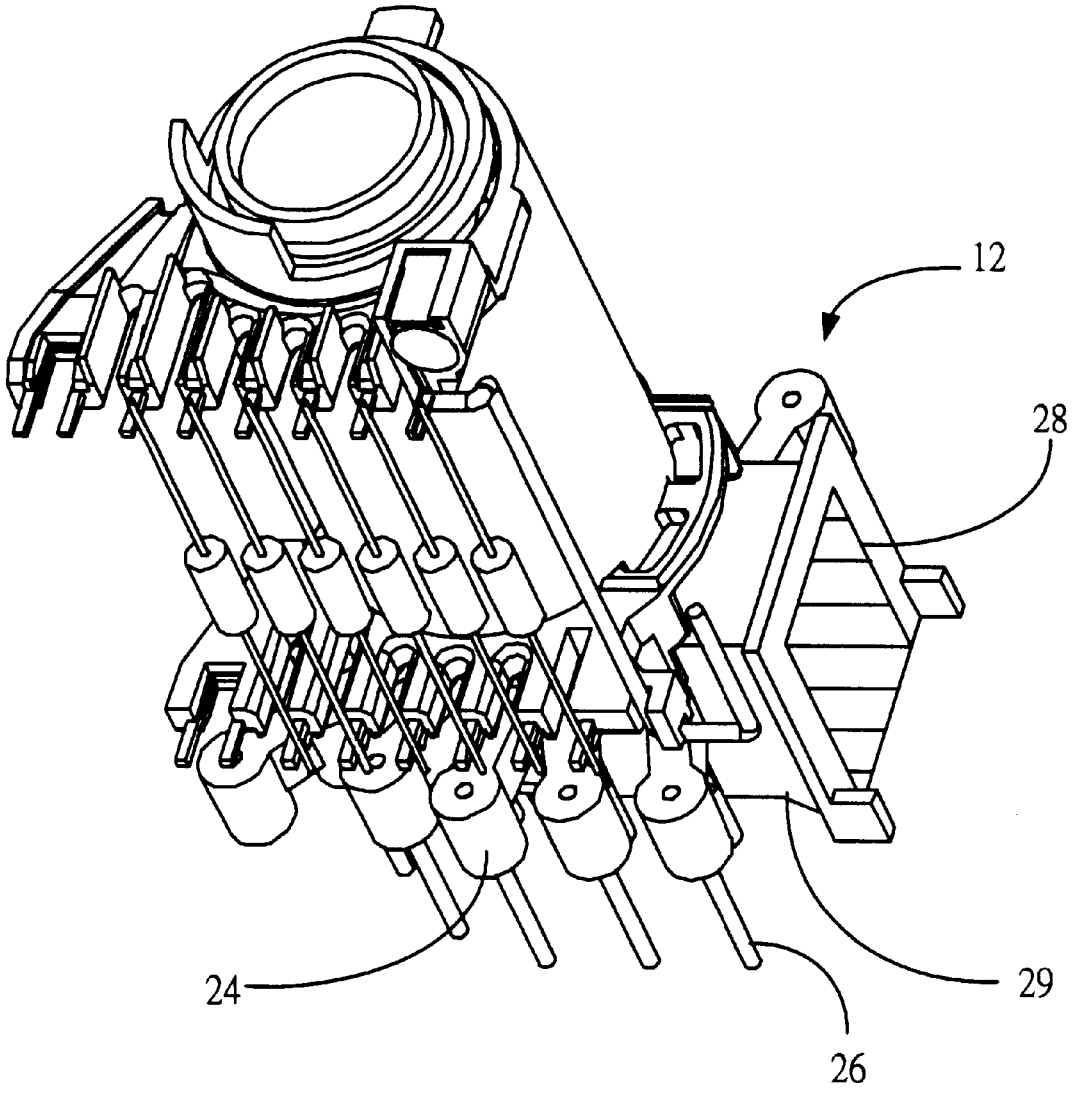
FIG. 3 (PRIOR ART)
FIG. 3 is a schematic diagram of a reinforced rib of the low-voltage bobbin 12 according to the prior art
Figure 4:
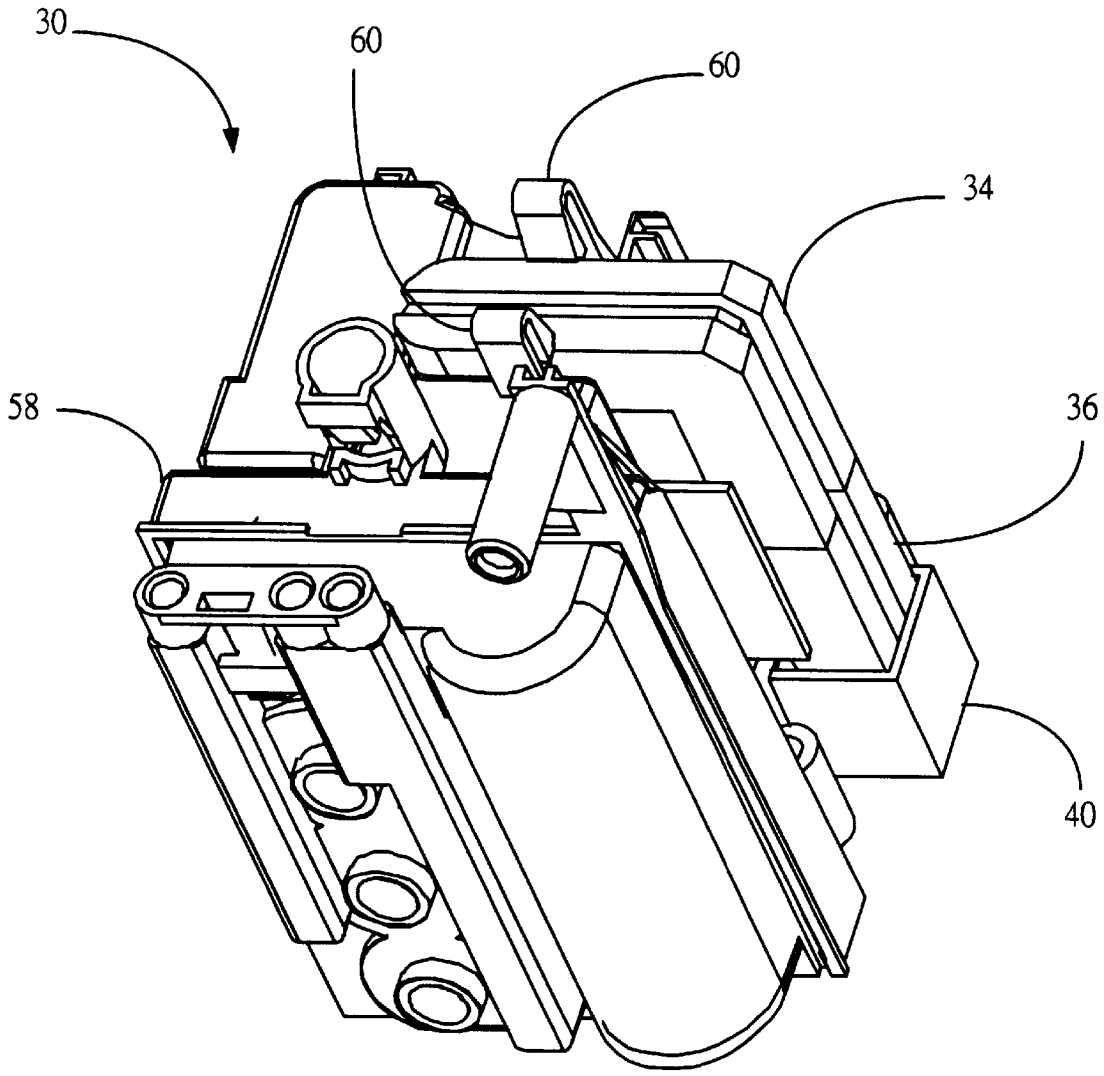
FIG. 4 is a schematic diagram of a flyback transformer applied with a low-voltage bobbin of the present invention.
Figure 5:
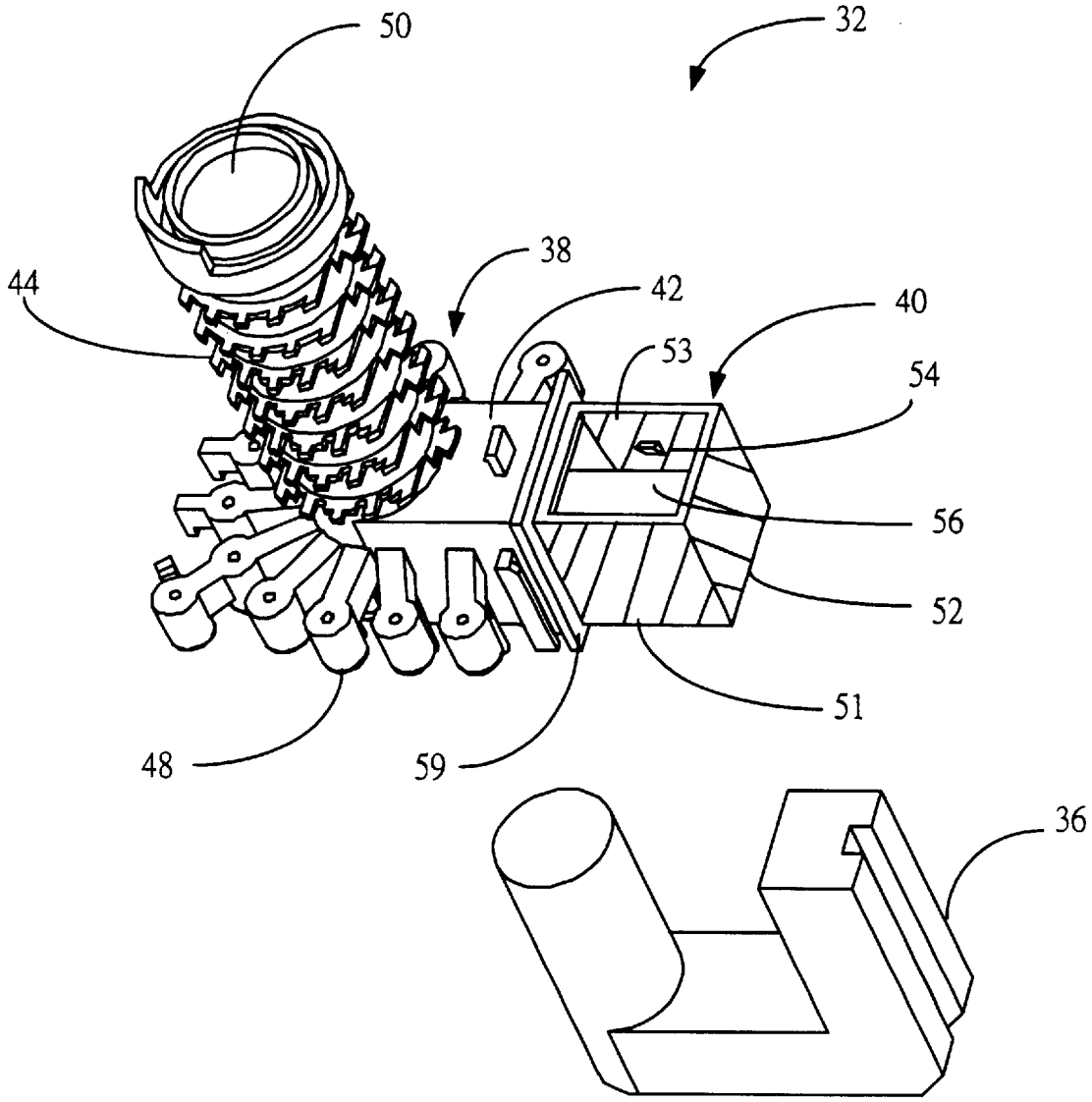
FIG. 5 is an assembly schematic diagram of the low-voltage bobbin of the present invention and the lower core.

Please refer to FIGS. 4 and 5. FIG. 4 is a schematic diagram of a flyback transformer 30 applied with a low-voltage bobbin 32 of the present invention. FIG. 5 is an assembly schematic diagram of the low-voltage bobbin 32 of the present invention and the lower core 36. The present invention provides a low-voltage bobbin 32 of a flyback transformer 30. The flyback transformer 30 comprises the low-voltage bobbin 34 (not shown in FIG. 4), an upper core 34 and a lower core 36. The low-voltage bobbin 32 comprises a main body 38 and a reinforced device 40. The main body 38 comprises a skirt 42 and a winding shaft 44. The skirt 42 has a lower opening (not shown) for receiving the lower core 36. A plurality of sockets 48 provided on a side portion of the skirt 42. The winding shaft 44 is provided on the skirt 42 and has an upper opening 50 for receiving the upper core 34.

The reinforced device 40 is provided on the skirt 42 for reinforcing rigidity of the main body 38 and preventing the plurality of sockets 48 from displacing. The reinforced device 40 comprises three ribs 51, 52, 53 and two lower mounting devices 54. Each of the three ribs 51, 52, 53 is vertically connected with each other to form a hole 56. And the three ribs are integrally formed on a flange 59 of the skirt 42. The two lower mounting devices 54 are positioned on the corresponding ribs 51, 53 respectively and located in the hole 56 for mounting the lower core 36.

Figure 6:
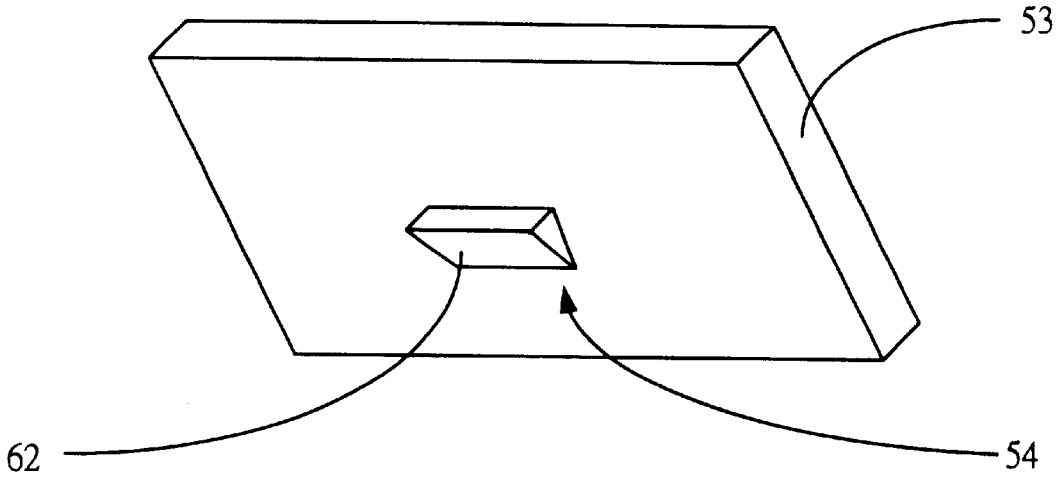
FIG. 6 is a schematic diagram of a lower mounting device of the reinforced device shown in FIG. 5.
Figure 7:
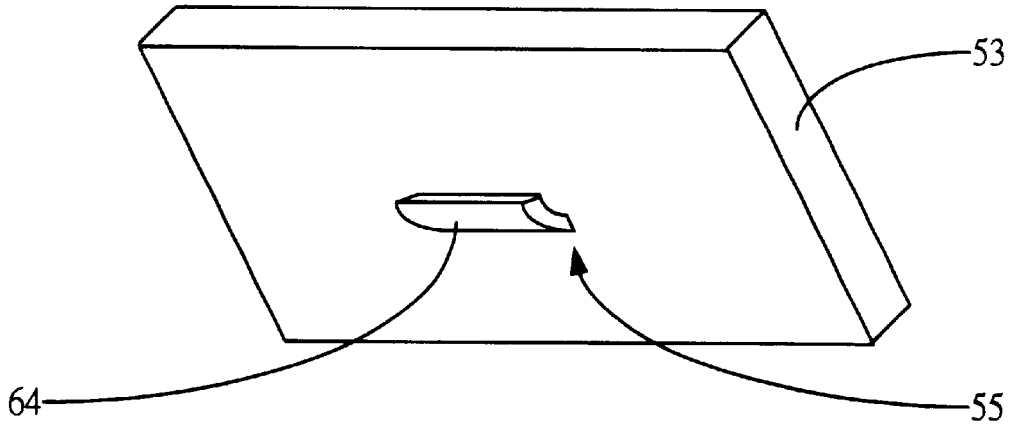
FIG. 7 is another embodiment of the lower mounting device.

Please refer to FIGS. 4, 6 and 7. FIG. 6 is a schematic diagram of a lower mounting device 54 of the reinforced device 40 shown in FIG. 5. FIG. 7 is another embodiment of the lower mounting device 55. Both the mounting devices 54 could be a prism 62 integrally formed on the corresponding ribs 51, 53 for mounting the lower core 36 as shown in FIG. 6. In addition, both of the mounting devices 55 could be a hook 62 integrally formed on the corresponding ribs 51, 53 for mounting the lower core 36 as shown in FIG. 7. Furthermore, the flyback transformer 30 further comprises a housing 58 and a high-voltage bobbin (not shown). The housing 58 has two upper mounting devices 60 wherein each mounting device 60 could be an hook for mounting the upper core 34 as shown in FIG. 4.

The assembly procedure of the flyback transformer 30 applied with the low-voltage bobbin 32 of the present invention comprises: first, installing the winding shaft 44 of the low-voltage bobbin 32 into a shaft hole (not shown) of the high-voltage bobbin; secondly, installing the high-voltage bobbin and low-voltage bobbin 32 into the housing 58; and then, mounting the upper core 34 on the housing 58 through the winding shaft 44 by the upper mounting devices 60, and concurrently mounting the lower core 36 on the low-voltage bobbin 32 through the skirt 42 by the lower mounting devices 54, 55; finally, performing a plastic injection process within the high-voltage bobbin, the low-voltage bobbin 32 and the housing 58 wherein the plastic injection process is the process of injecting melted plastic and forming solid state plastic by cooling within the high-voltage bobbin, the low-voltage bobbin 32 and the housing 58.

In comparison with the low-voltage bobbin 12 according to the prior art, the low-voltage bobbin 32 of the present invention applies the reinforced device 40 integrally formed on the skirt 42 of the main body 38. The socket displacement of the low-voltage bobbin 32 is reduced due to rigidity reinforcement of the main body 38 by the reinforced device 40. In addition, the reinforced device 40 comprises three ribs 51, 52, 53 vertically connected with each other to form a hole 56. The lower core 36 will be engaged with the low-voltage bobbin 32 through the hole 56 by the lower mounting devices 54, 55. Therefore, said clip 22 of the prior art will not be a necessary component for mounting the lower core 36 on the low-voltage bobbin of the present invention. The cost of the flyback transformer 30 applied with the low-voltage bobbin 32 of the present invention will also be reduced.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A low-voltage bobbin of a flyback transformer, the flyback transformer comprising the low-voltage bobbin, a lower core and an upper core, the low-voltage bobbin comprising:

a main body comprising a skirt and a winding shaft, the skirt having a lower opening for receiving the lower core, and a plurality of sockets provided on a side portion of the skirt, the winding shaft being provided on the skirt and having an upper opening for receiving the upper core; and a reinforced device provided on the skirt for reinforcing rigidity of the main body and preventing the plurality of sockets from displacing;

wherein the reinforced device provides a hole, the lower core engages with the low-voltage bobbin through the hole according to a predetermined assembly procedure.

2. The low-voltage bobbin of claim 1 wherein the reinforced device comprises three ribs integrally formed on a flange of the main body, each rib is vertically connected with each other to form the hole.

3. The low-voltage bobbin of claim 2 wherein the reinforcing device further comprises at lease one lower mounting device for mounting the lower core, each lower mounting device is integrally formed on the corresponding rib and located in the hole.

4. The low-voltage bobbin of claim 3 wherein the flyback transformer further comprises a housing, at lease one upper mounting device is provided on the housing for mounting the upper core.

5. The low-voltage bobbin of claim 4 wherein the flyback transformer further comprises a high-voltage bobbin, the predetermined assembly procedure comprises:

installing the winding shaft of the low-voltage bobbin into a shaft hole of the high-voltage bobbin;

installing the high-voltage bobbin and low-voltage bobbin into the housing;

mounting the upper core on the housing through the winding shaft by the upper mounting device, and concurrently mounting the lower core on the low-voltage bobbin through the skirt by the lower mounting device; and performing a plastic injection process within the high-voltage bobbin, low-voltage bobbin and housing.

* * * * *